US011352170B2

(12) United States Patent
Dag

(10) Patent No.: US 11,352,170 B2
(45) Date of Patent: Jun. 7, 2022

(54) STACKABLE PACKAGING CONTAINER

(71) Applicants: Papacks Sales GmbH, Cologne (DE); GOERNER FORMPACK GMBH, Klagenfurt (AT)

(72) Inventor: Tahsin Dag, Cologne (DE)

(73) Assignees: Papacks Sales GmbH, Cologne (DE); Goerner Formpack GmbH, Klagenfurt (AT)

( * ) Notice: Subject to any disclaimer, the term of this patent is extended or adjusted under 35 U.S.C. 154(b) by 599 days.

(21) Appl. No.: 15/529,760

(22) PCT Filed: Nov. 19, 2015

(86) PCT No.: PCT/EP2015/077037
§ 371 (c)(1),
(2) Date: May 25, 2017

(87) PCT Pub. No.: WO2016/083222
PCT Pub. Date: Jun. 2, 2016

(65) Prior Publication Data

US 2017/0305596 A1 Oct. 26, 2017

(30) Foreign Application Priority Data

Nov. 28, 2014 (DE) ..... 202014105771.4
Mar. 2, 2015 (DE) ..... 202015100997.6
Jun. 22, 2015 (DE) ..... 202015103273.0

(51) Int. Cl.
*B65D 21/02* (2006.01)
*B65D 5/72* (2006.01)
(Continued)

(52) U.S. Cl.
CPC ..... *B65D 21/0223* (2013.01); *B65D 5/001* (2013.01); *B65D 5/005* (2013.01);
(Continued)

(58) Field of Classification Search
CPC ..... B65D 5/001; B65D 5/005; B65D 21/023; B65D 21/0223; B65D 21/0209;
(Continued)

(56) References Cited

U.S. PATENT DOCUMENTS 3,194,426 A 7/1965 Brown
5,611,426 A * 3/1997 Warfield ..... B65D 5/4204 206/308.1

(Continued)

FOREIGN PATENT DOCUMENTS

CN 2673636 Y 1/2005
CN 201140824 Y 10/2008

(Continued)

*Primary Examiner* — Don M Anderson
(74) *Attorney, Agent, or Firm* — Muirhead and Saturnelli, LLC

(57) ABSTRACT

A packaging container having a top side, a bottom side extending parallel to the top side, and at least one side wall extending between the top side and the bottom side. The top side can have at least one protrusion, and the opposite side extending parallel can have at least one recess, into which a protrusion of a packaging container, for example, an identically shaped packing container, can be inserted. Such a packaging container can be produced in an economical and environmentally friendly manner, for example, by having holes punched in the top side and in the bottom side, and the protrusions and recesses attached in inserts, which are inserted into the packaging container.

20 Claims, 15 Drawing Sheets

(51) Int. Cl.

| | |
|---|---|
| ***B65D 5/00*** | (2006.01) |
| ***B65D 5/20*** | (2006.01) |
| ***B65D 5/50*** | (2006.01) |
| ***B65D 5/42*** | (2006.01) |
| ***B65D 5/38*** | (2006.01) |
| ***B65D 5/68*** | (2006.01) |
| ***B65D 5/54*** | (2006.01) |
| ***B65D 5/02*** | (2006.01) |

(52) U.S. Cl.
CPC ..... *B65D 5/0015* (2013.01); *B65D 5/02* (2013.01); *B65D 5/20* (2013.01); *B65D 5/38* (2013.01); *B65D 5/4204* (2013.01); *B65D 5/503* (2013.01); *B65D 5/542* (2013.01); *B65D 5/5435* (2013.01); *B65D 5/68* (2013.01); *B65D 5/725* (2013.01); *B65D 21/023* (2013.01); *B65D 21/0209* (2013.01); *B65D 21/0235* (2013.01)

(58) Field of Classification Search
CPC .. B65D 5/5435; B65D 23/0842; B65D 5/503; B65D 5/725; B65D 21/0235; B65D 5/20; B65D 5/0015
See application file for complete search history.

(56) References Cited

U.S. PATENT DOCUMENTS

| | | | | |
|---|---|---|---|---|
| 6,431,436 | B1 * | 8/2002 | Evers | B65D 5/448 206/504 |
| 8,317,024 | B1 | 11/2012 | Persi | |
| 2005/0109827 | A1 * | 5/2005 | Martin | B65D 5/5435 229/232 |
| 2010/0006467 | A1 | 1/2010 | Joseph et al. | |
| 2011/0174655 | A1 * | 7/2011 | Gonn | B65D 5/001 206/503 |
| 2013/0146498 | A1 * | 6/2013 | Chen | B65D 21/0209 206/509 |
| 2013/0334234 | A1 | 12/2013 | Vernon et al. | |
| 2014/0027337 | A1 | 1/2014 | Marchetti et al. | |

FOREIGN PATENT DOCUMENTS

| | | | |
|---|---|---|---|
| CN | 201406139 | Y | 2/2010 |
| CN | 102470973 | A | 5/2012 |
| CN | 202337457 | U | 7/2012 |
| DE | 87 09 277.8 | | 10/1988 |
| DE | 43 34 530 | A1 | 4/1995 |
| DE | 198 08 013 | A1 | 9/1999 |
| DE | 101 02 239 | A1 | 4/2002 |
| DE | 20 2010 010 168 | U1 | 11/2010 |
| DE | 20 2014 105 771 | U1 | 2/2015 |
| EP | 2 455 302 | B1 | 9/2013 |
| GB | 2 147 883 | A | 5/1985 |
| WO | WO 2013/114060 | A1 | 8/2013 |

* cited by examiner

STACKABLE PACKAGING CONTAINER

TECHNICAL FIELD

The system described herein relates to a container for packaging any desired goods. Such containers are usually cuboidal, but can also have a round or polygonal contour. Goods packaged therein are for example foodstuffs such as chocolates, electronic articles such as smartphones, tablets, laptops, or shoes.

BACKGROUND OF THE INVENTION

Such packaging containers having a lower part and an upper part, or lid, engaging around the lower part are known. Packaging containers consisting of cardboard or corrugated board, which have nub-like protrusions on their top side, are also known.

The documents U.S. Pat. No. 3,194,426 A, DE 43 34 530 A1 and DE 20 2014 105 771 U1 show various containers with protrusions on the top side and recesses on the underside.

SUMMARY OF THE INVENTION

The system described herein is based on designing a packaging container made of cardboard, corrugated board, pressboard, fiber molding compound or the like having protrusions on the top side and recesses on the underside such that it is able to be produced in a convenient and environmentally friendly manner. In one embodiment, the packaging container should be able to serve as a component of a display rack.

Described herein is a packaging container having a top side, an underside extending parallel thereto, and at least one side wall extending from the top side to the underside. The top side is formed by the cover wall of the container and the underside is formed by the base of the container. The side wall extends between the peripheries of the cover wall and base wall. In the case of a round container, the side wall is cylindrically curved and extends between a circular cover wall and a circular base. In the case of a cuboidal container, the side wall consists of four wall portions that adjoin one another at right angles. In some embodiments, the top side is provided with at least one protrusion and the underside is provided with at least one recess into which a protrusion arranged on the top side of a second identically shaped packaging container is able to be plugged. However, it is also possible for the protrusions to be arranged on the underside and the recesses on the top side. It is also possible to arrange one or more protrusions on the underside with complementary recesses on the underside and one or more protrusions on the underside with complementary recesses on the top side. The protrusions and recesses should be arranged such that the protrusions of the first container project into recesses of the second container in the case of two identically shaped containers stacked one on top of the other. In some embodiments, the protrusions are arranged on a side of the container such that they form stable bearing surfaces so that the container can be placed stably on the protrusions. Holes have been punched in the top side and in the underside, wherein the protrusions and the recesses have been applied to inserts which have been inserted into the packaging container. The inserts can consist of plastic. The inserts can also consist of a biodegradable fiber material. In particular, molded pulp made of pulp fibers is suitable for producing the inserts. The material is visually very appealing but at the same time cost-effective and environmentally friendly because it is able to be produced from recycled waste paper. Using molded-pulp technology, inserts of variable shapes can be produced. Alternatively, the inserts can also be deep-drawn from paper material or cardboard material in any desired colors. The inserts can fulfill further functions in addition to forming the recesses and protrusions. Thus, the inserts can have, on the side remote from the top side and underside, respectively, of the container, receptacles for products to be received in the container. In other words, the inserts can have tray-like regions or depressions, the shape of which matches the contour of the products to be received. The products to be received are placed in these tray-like depressions of the inserts such that they cannot move within the container during transport. The inserts can be fastened to the top side and the underside. However, they can also be introduced into a packaging container comprising, or consisting of, an upper part and a lower part and be enclosed with slight play by the upper part and the lower part of the packaging container such that, in this way, they are fixed with regard to the top side and underside of the packaging container.

In this way, the packaging container can be stacked optimally and in a manner secured against shifting. The protrusion on the cover wall of the lower packaging container projects into the complementary recess in the base of the upper packaging container and secures the latter against slipping. The protrusion can in this case have any desired shape and form, for example, symbols such as letters and numbers, and logos or representations of the packaged products. It improves the visual appearance of the container and at the same time serves as a transport lock.

In practice, the packaging container can be cuboidal. In particular in the case of a cuboidal embodiment of the packaging container, the latter can also serve as a component of a display rack. For this purpose, at least one side wall of the packaging container can be entirely or largely able to be folded open. This container has the advantage that the goods can be viewed after the side wall has been opened.

The side wall that is able to be folded open can be connected to the remaining part of the side wall or to the adjoining walls of the container via a perforation or via an adhesive strip.

A drawer can be arranged on the underside of the packaging container, said drawer being able to be extended with the side wall open.

Furthermore, in the case of a cuboidal container, that part of the side wall that is able to be folded open can be connected to the remaining part of the side wall via a perforation extending in the vicinity of and parallel to the upper horizontal side edge and in the vicinity of and parallel to the two vertical side edges. In the case of round packaging containers or packaging containers with other shapes, the perforations can accordingly be arranged such that the region that is able to be folded open exposes a large part of the area of the container that is visible in plan view.

The perforation can be formed by a tear-off perforation strip formed by two parallel perforation lines. A weakening line can have been embossed in the vicinity of and parallel to the lower side edge, the window cut out by the perforation being able to be turned down along said weakening line.

A cuboidal packaging container can be provided on its top side with four, six or eight conical, i.e. frustoconical protrusions and on its underside with the same number of, namely four, six or eight, receiving recesses of complementary shape. The protrusions and receiving recesses can in practice be distributed in pairs along the length of the container, i.e. pairs of protrusions or receiving recesses arranged alongside one another are each arranged at defined spacings in the longitudinal direction of the container. In this case, the spacing between the two protrusions or recesses of a pair can correspond to the spacing of successive pairs. In this way, not only can containers be arranged in a flush manner on one another, they can also be arranged in a manner offset by a half, a third or a quarter of the container length or at 90° with respect to one another, wherein the protrusions of the lower containers project into the receiving recesses of the upper containers. In this way, a display rack for the products received in the containers can be assembled from the containers. The rack is very stable and can be used to display and compare shoes, toys or other goods.

In practice, the two inserts can be constituent parts of a cardboard blank which has the following portions that are connected together via bending lines:

- a receiving portion with at least one receptacle, the shape of which matches the shape of a product to be received in the container;
- a first side-wall portion;
- a first cover-wall portion, which has at least one recess;
- a second side-wall portion;
- a second cover-wall portion, which has at least one protrusion with a shape and position complementary to the recess.

The cardboard blank is bent through 90 degrees at each bending line, wherein all of the bending lines extend parallel to one another. This results in a cuboid, the top side of which is formed by one of the cover-wall portions and the underside of which is formed by the second cover-wall portion. In practice, the first cover-wall portion with the recess can be the lower insert of the container. The second cover-wall portion with the protrusion then forms the upper insert of the container. After being bent along the bending lines, the cardboard blank forms a cuboidal packaging element. The cuboidal packaging element can be inserted into a box-like receiving carton with the hole, the contour of which in plan view corresponds in shape and position to the contour of the recess in the first, lower cover-wall portion. A lid with a hole, the contour of which corresponds in shape and position to the contour of the protrusion on the second, upper cover-wall portion, can close the box-like receiving carton.

In some embodiments, in the case of a cardboard blank bent to form a cuboidal packaging element, the protrusions on the second cover-wall portion are located at the same position as the recesses in the first cover-wall portion when two containers with such cuboidal packaging elements are stacked, such that protrusion and recess engage in one another in a form-fitting manner. Of course, the shape of the recess and protrusion likewise correspond to one another. If a plurality of protrusions are provided on the second cover-wall portion and a plurality of recesses are provided in the first cover-wall portion, in each case one recess of the first cover-wall portion corresponds in shape and position to a protrusion of the second cover-wall portion.

The receptacles for the products can have any desired configurations. In most cases, they are receiving recesses into which the products to be received are able to be inserted and in which the products to be received are fixed. However, other fastening structures are suitable for fastening products to be received in the receiving portion of the cardboard blank.

In the case of two-part packaging having a lower part and an upper part, a window can have been punched out of the longitudinal side of the lower part, said longitudinal side coming to rest against the longitudinal wall of the upper part, said window corresponding, after the upper part has been put on, to that part of the side wall that is able to be folded open. In this way, two-part packaging can also be provided with a display window.

In another embodiment, in which the recesses and protrusions are not necessarily conical, the at least one protrusion and the at least one recess can in practice have complementary shapes and be applied at mutually corresponding positions such that the underside of a second identically shaped packaging container is able to be placed in a flush manner on the top side of a packaging container, wherein the protrusion on the top side projects into the recess of complementary shape on the underside. These types of packaging can be stacked with a substantially identical space requirement to conventional types of packaging, but are secured against slipping in the transverse direction.

In practice, the at least one protrusion on the top side can have the shape of a symbol, in particular a number or a letter. For example, the protrusion can represent a company logo or the letters of a company name. Furthermore, in practice, the at least one protrusion can have the shape of a product received in the container. Combinations are also possible, for example a protrusion in the shape of a product, a protrusion in the shape of the company logo and optionally several protrusions in the shape of the letters of the company name. For each protrusion on the top side of the packaging container, a receiving recess of complementary shape can be provided on the underside of the packaging container.

In practice, the protrusions can project at least about 2 mm from the surface of the top side, wherein the recesses are correspondingly at least about 2 mm deep. In this way, effective securing against slipping is formed.

BRIEF DESCRIPTION OF THE DRAWINGS

In the following description, exemplary embodiments of the packaging container according to embodiments of the system described herein are described in more detail with reference to the drawings, in which.

DESCRIPTION OF VARIOUS EMBODIMENTS

Figure 1:
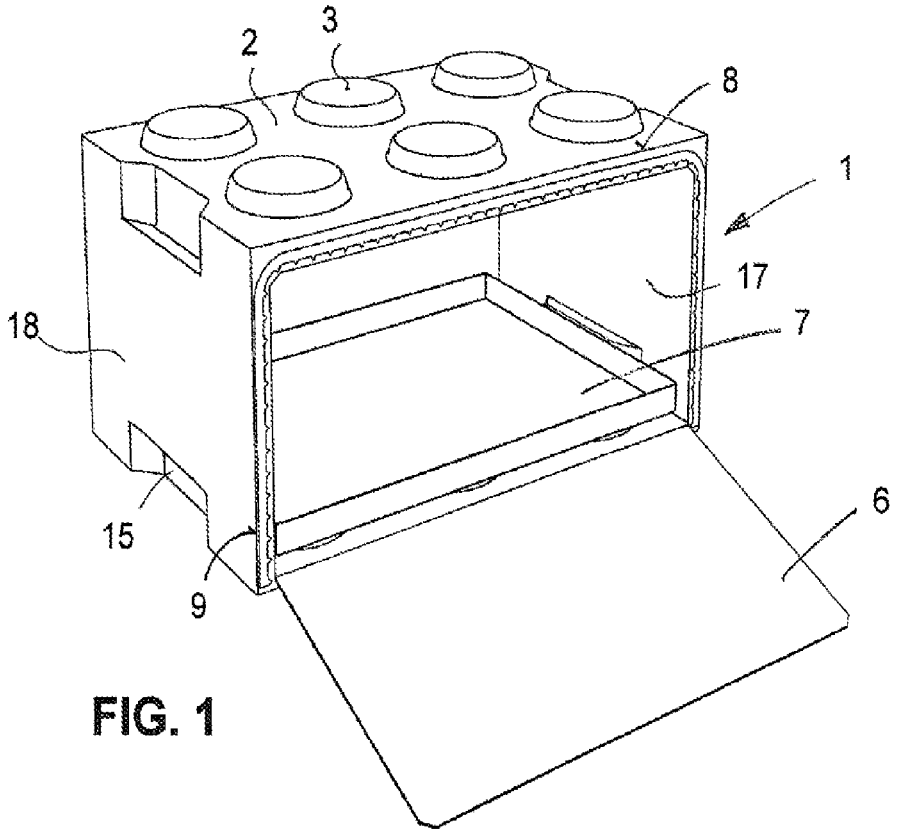
FIG. 1 shows a perspective view, obliquely from above, of the packaging container with the side wall open, according to embodiments of the system described herein.
Figure 2:
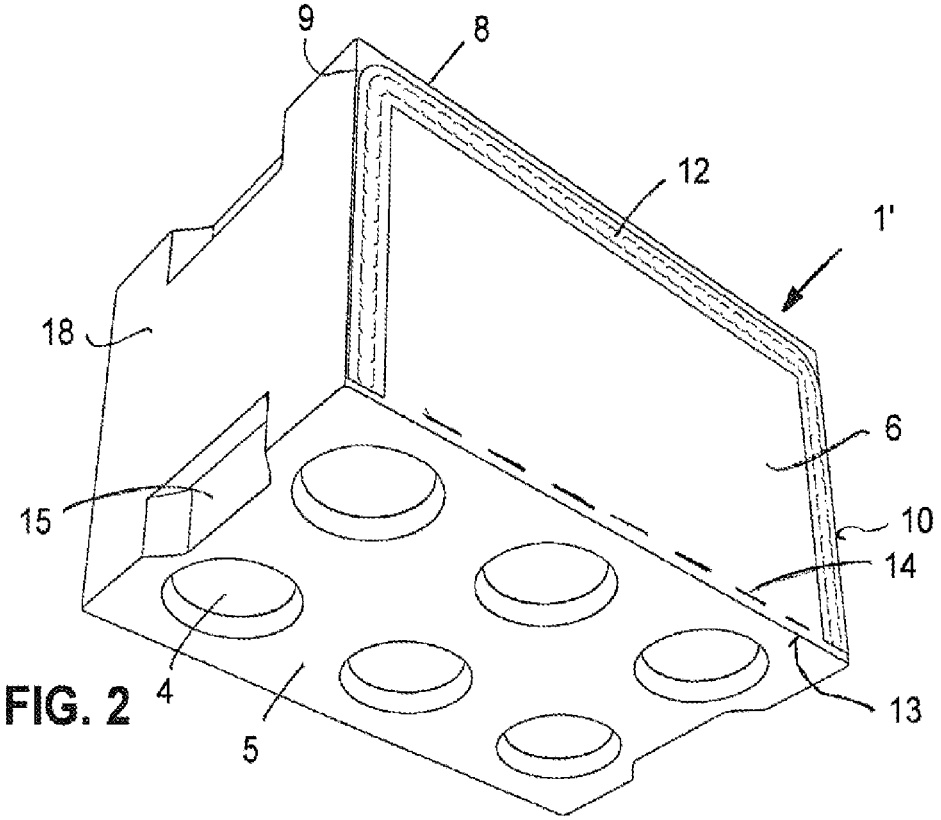
FIG. 2 shows a perspective view, obliquely from below, of the packaging container with the side wall closed, according to embodiments of the system described herein.

The packaging container 1 according to FIG. 1 and FIG. 2 is cuboidal and has, on its top side 2, conical protrusions 3 and, in its underside 5, complementary, conical recesses 4 into which protrusions 3 arranged on the top side 2 of a second identically shaped packaging container 1' are able to be plugged. The front side wall 6 of the packaging container 1 is able to be folded open entirely or largely apart from narrow rims. Arranged on the base 5 of the container 1 is a drawer 7 which is able to be extended with the side wall 6 open and in the process slides on the recesses 5 embossed in the base 5. The drawer 7 is guided between the recessed grips 15 provided in the transverse walls 17, 18. The conical protrusions 3 can of course also be arranged on the underside 5 and the recesses 4 in the top side 2 of the packaging container 1.

Figure 3:
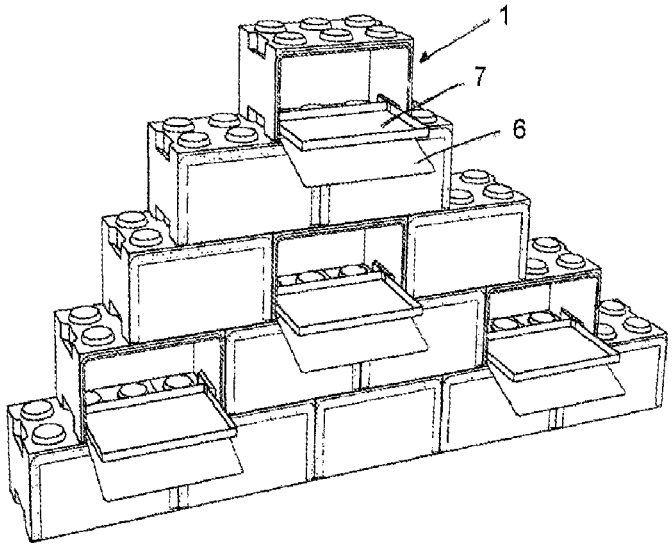
FIG. 3 shows a view of a rack made up of packaging containers according to FIG. 1 and FIG. 2, according to embodiments of the system described herein.

Six conical protrusions 3 are integrally formed in the top side 2 and six receiving recesses 4 are integrally formed in the underside. With this packaging container 1, a stable rack can be built—as shown in FIG. 3. Depending on the desired size of the packaging containers 1, ones with four or eight conical protrusions 3 and receiving recesses 4 are also possible, which correspond to the containers with six protrusions 3 and recesses 4.

Figure 4:
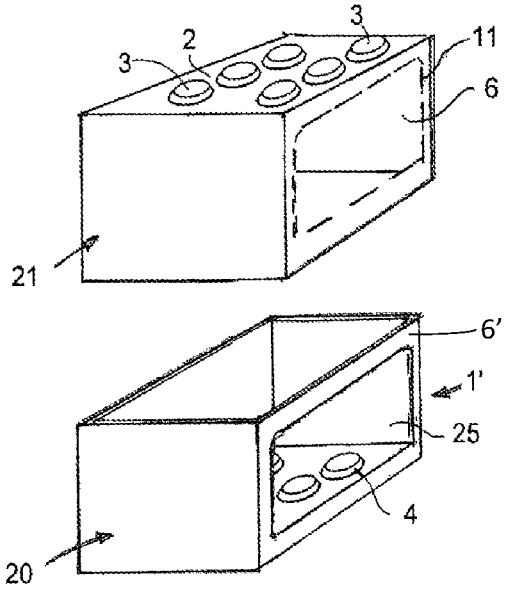
FIG. 4 shows a perspective view of a packaging container consisting of an upper part and a lower part, according to embodiments of the system described herein.

FIG. 4 shows an illustrative embodiment in which the packaging container 1 is made up of a lower part 20 and an upper part 21 engaging around the lower part 20. The conical protrusions 3 have been embossed in the top side 2 of the upper part 21 and the recesses 4 have been embossed in the underside 5. In the lower part 20, a window 25 has been cut out of the side wall 6', said window 25 corresponding to that part of the side wall 6 of the upper part 21 that is able to be folded open.

Figure 5:
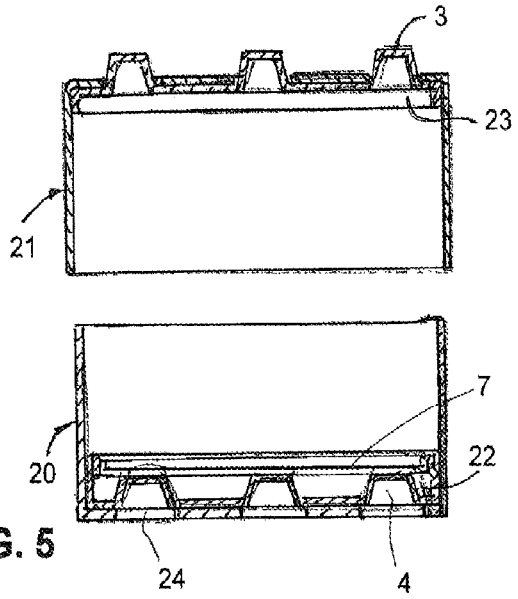
FIG. 5 shows a sectional view of a further embodiment of the packaging container.

The packaging container according to FIG. 5 is also made up of a lower part 20 and an engaging upper part 21. In this case, the protrusions 3 and recesses 4 are not integrally formed in the top side 2 of the upper part 21 and in the underside 5 of the lower part 20, but rather, round holes 24 have been punched out, the diameter of which is the same as or slightly greater than the largest diameter of the protrusions 3 and of the recesses 4. An insert 22 having recesses 4 which are located above the holes 24 has been inserted into the lower part 20. An insert 23 having conical protrusions 3 which pass through the holes 24 has been inserted into the upper part 21. This embodiment has the advantage that the walls of the packaging container 1 can consist of a material that has low deformability but is readily able to be folded up, while the inserts can consist of a more dimensionally rigid material, for example plastic, or of a biodegradable fiber molding material.

Figure 6:
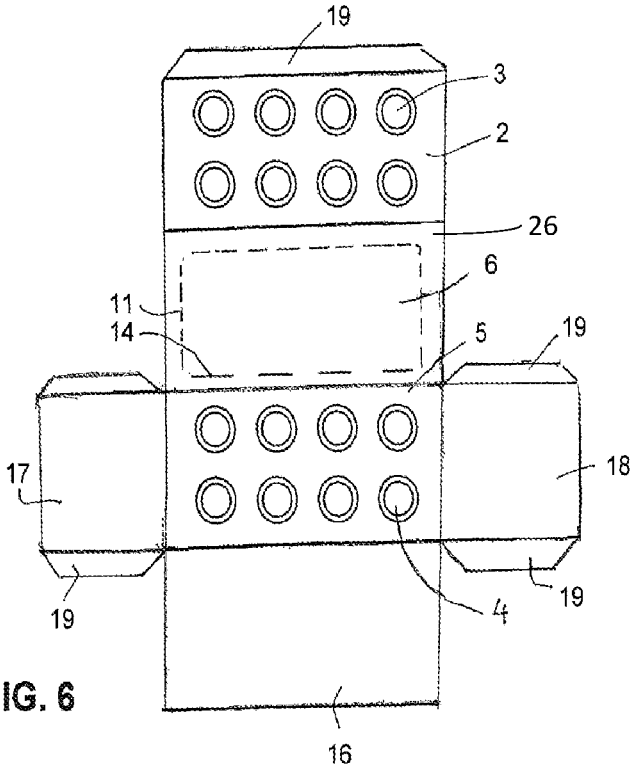
FIG. 6 shows a paperboard blank for a packaging container, according to embodiments of the system described herein.

As FIG. 6 shows, the six walls 2, 5, 6, 16, 17 and 18 of the packaging container 1 shown here are formed from a paperboard blank 26. The container receives its stability via tabs 19, which are bent at right angles during the erection of the container 1 and are fastened to the adjacent walls by adhesive bonding or stitching.

The conical protrusions 3, the receiving recesses 4 and the perforation 11 and a folding line 14 for that part of the side wall 6 that is able to be folded open can have been embossed or punched into the paperboard or cardboard blank 26. Depending on the deformability of the walls, comprising, or consisting of, cardboard, paperboard, pressboard, hot-pressed fiber material provided with binders, or the like, of the packaging container 1, the protrusions 3 and the recesses 4 could have been embossed into the top side 2 and into the base 5 of the packaging container 1 by the cold pressing or hot pressing method.

Figure 7:
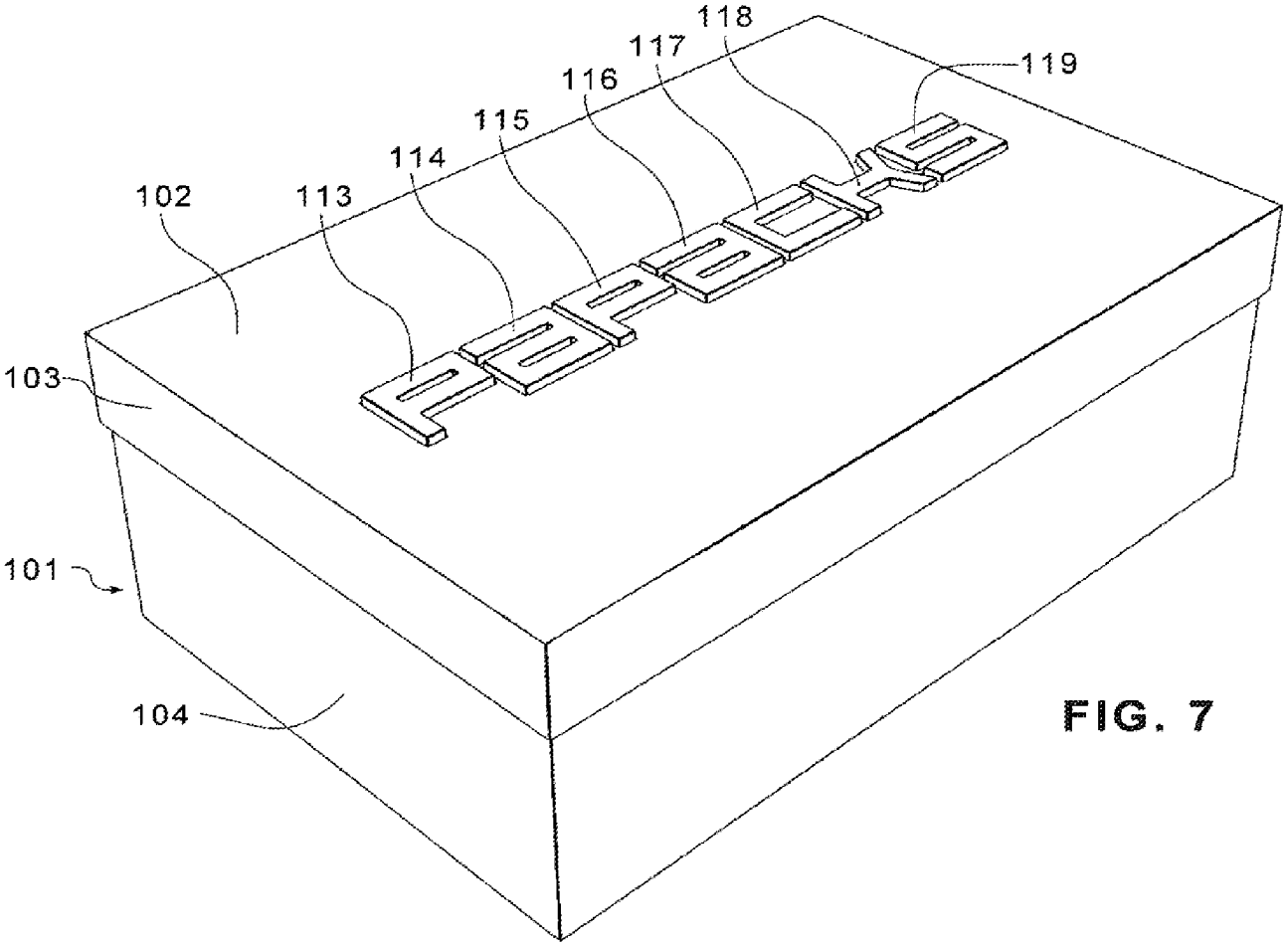
FIG. 7 shows a perspective plan view of another embodiment of a packaging container.

FIG. 7 shows an alternative embodiment of the packaging container 101 described herein. It is configured more like a conventional shoebox with a separate lid 103 and a box-like receiving carton 104. The cover wall of the lid 103 forms the top side 102 of the container. The base of the box-like receiving carton 104 forms the underside 105 of the packaging container 101. Both the lid 103 and the box-like receiving carton 104 are each manufactured in a known manner from a cardboard blank. Seven protrusions 113 to 119 are located on the top side 102. The protrusion 113 has the shape of the letter P, the protrusion 114 the shape of the letter A, the protrusion 115 the shape of the letter P, the protrusion 116 the shape of the letter A, the protrusion 117 the shape of the letter C, the protrusion 118 the shape of the letter K, and the protrusion 119 the shape of the letter S. The protrusions 113 to 119 read together reveal the company name of the applicant company.

Figure 8:
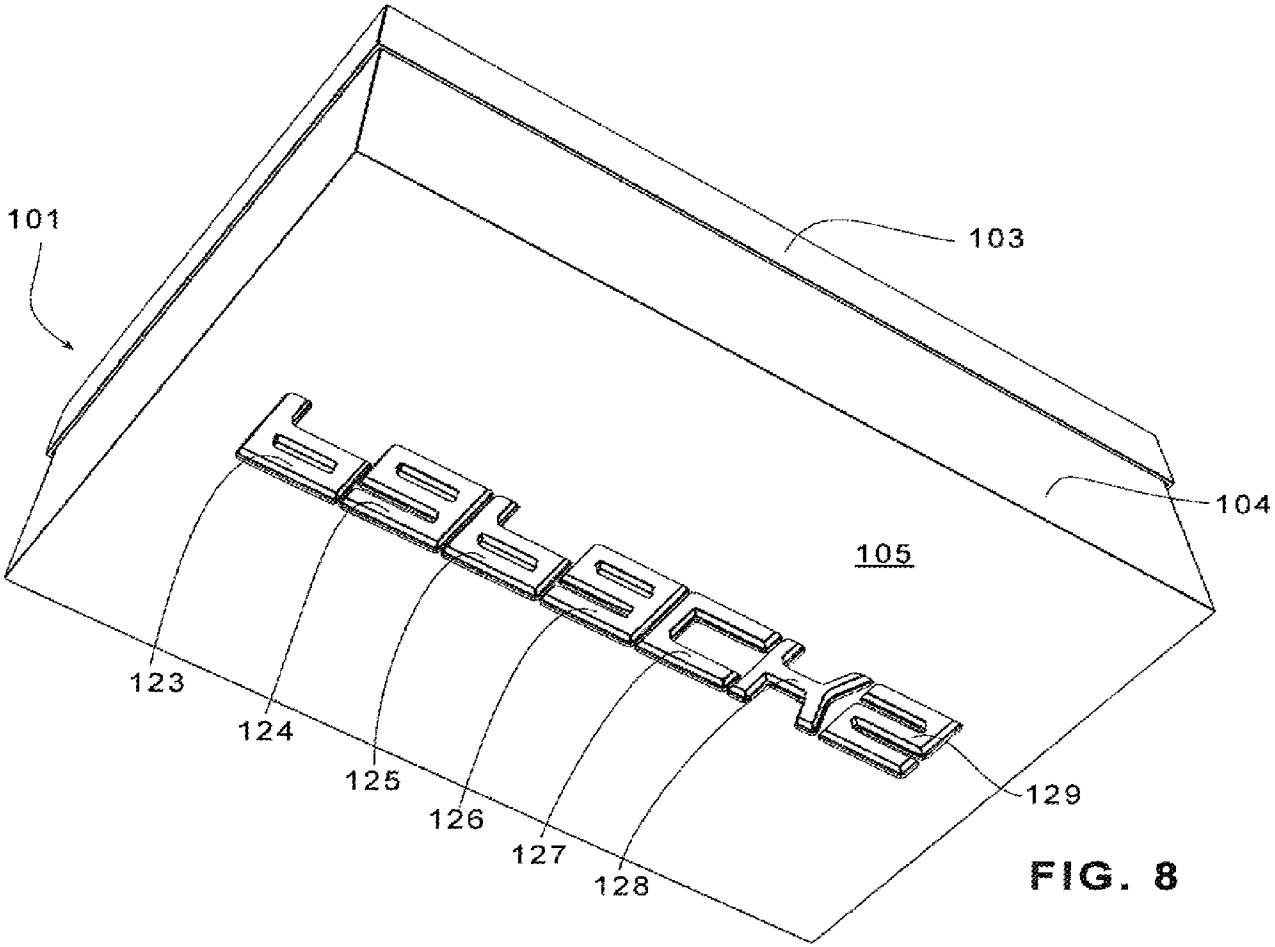
FIG. 8 shows a perspective bottom view of the packaging container from FIG. 7, according to embodiments of the system described herein.

FIG. 8 shows that the underside 105 of the packaging container 101 has recesses 123-129 of complementary shape. The dimensions of the recesses 123-129 are at least as large as the dimensions of the protrusions 113-119, optionally slightly larger, such that the protrusions 113-119 on the top side 102 of a first packaging container 101 are insertable with slight play into the recesses 123-129 on the underside 105 of a second identically shaped packaging container 101 when the containers are stacked one on the other. The protrusions 113-119 projecting into the recesses 123-129 secure two containers 101 stacked one on the other against slipping laterally.

Figure 9:
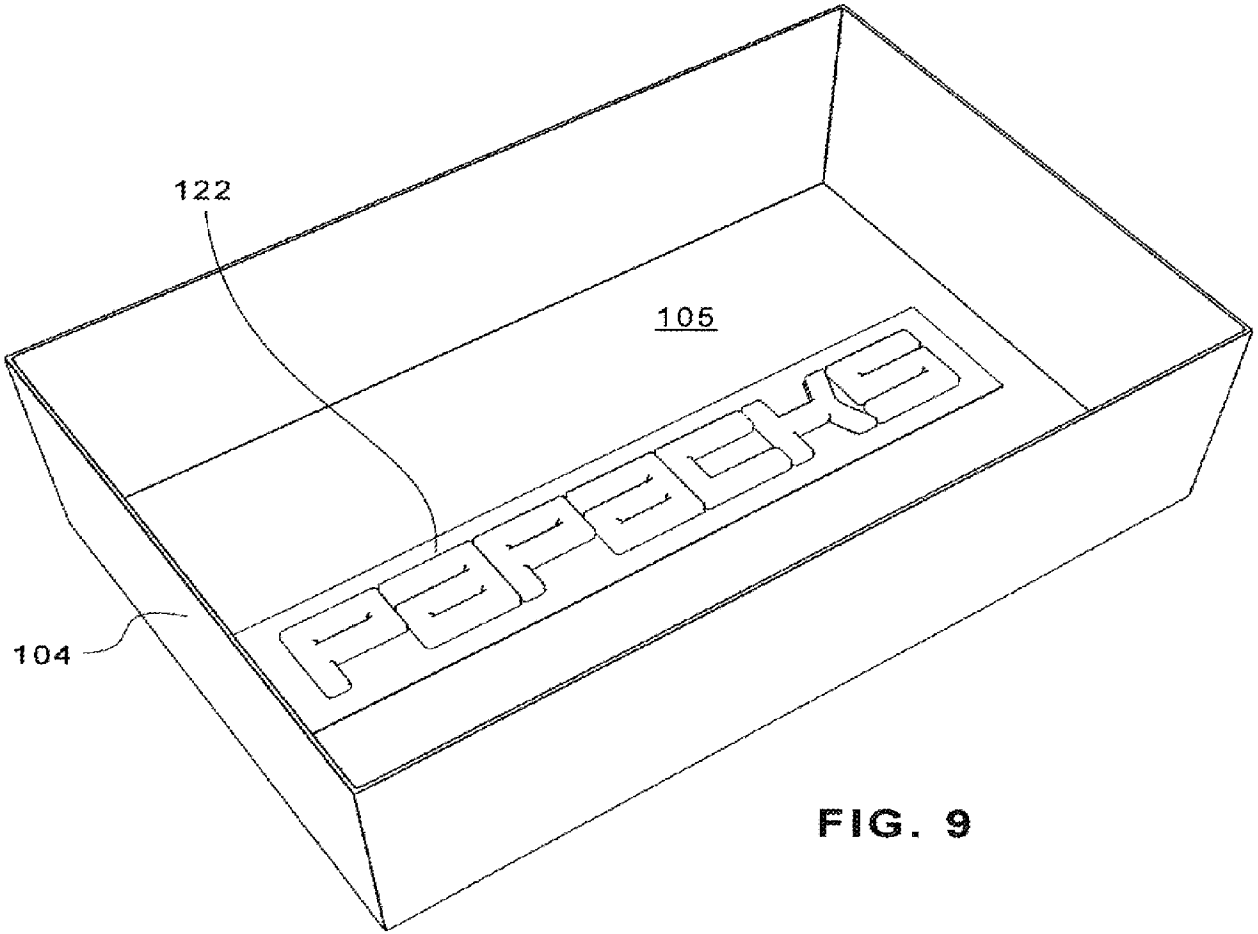
FIG. 9 shows a perspective plan view of the lower part of the packaging container from FIGS. 7 and 8, according to embodiments of the system described herein.

As described above, the recesses 123-129 and the protrusions 113-119 are formed by inserts. The insert 122 with recesses 123-129 can be seen on the inner side of the base 105 of the box-like receiving carton 104 in FIG. 9. It can likewise be seen that both the top side 102 and the underside 105 of the packaging container 101 have punched holes, the contours of which correspond to the contours of the recesses and protrusions, respectively. Accordingly, the insert with the protrusions 113-119 is adhesively bonded to the inner side of the lid 103.

Figure 10:
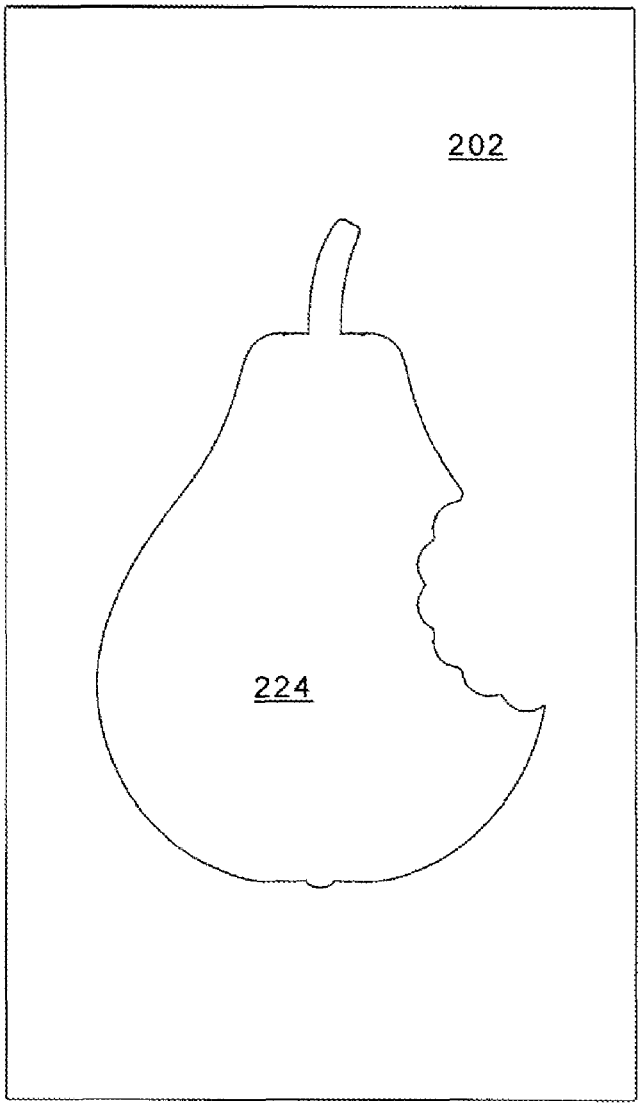
FIG. 10 shows a perspective plan view of the top side of another embodiment of the packaging container, according to embodiments of the system described herein.
Figure 11:
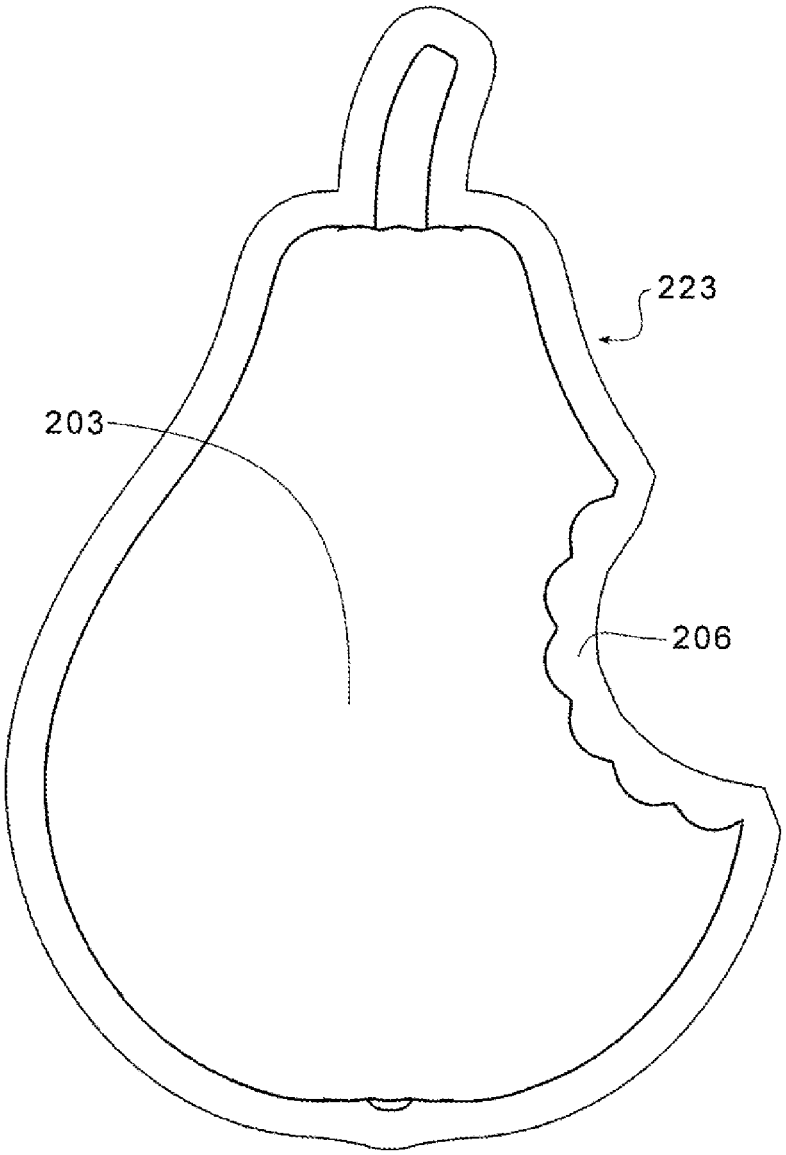
FIG. 11 shows a plan view of an insert for the packaging container from FIG. 10, according to embodiments of the system described herein.
Figure 12:
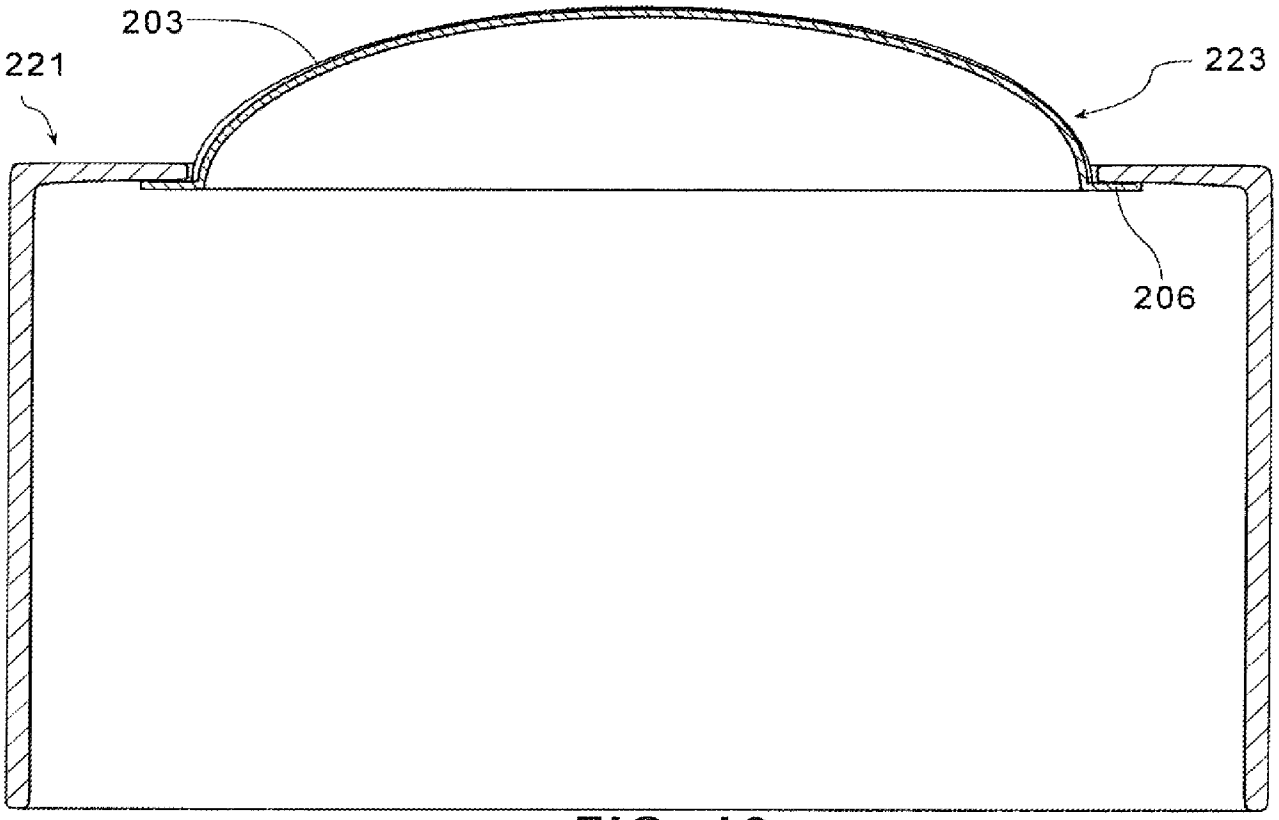
FIG. 12 shows a sectional side view of the upper part of the packaging container from FIG. 10 with the insert from FIG. 11, according to embodiments of the system described herein.

FIG. 10 shows the plan view of an alternative embodiment of a top side 202 of a packaging container of the type described herein. It can be seen that a hole 224 has been punched into the top side 202. FIG. 11 shows an insert 223 with a protrusion 203. The protrusion 203 is in this case illustrated for example in the form of a pear which has been bitten into. The protrusion 203 can adopt any desired shape which the user of the packaging selects in order to decorate the packaging. Around the protrusion 203, the insert 223 has a peripheral web 206 by way of which the insert 223 is able to be stuck into a top part 221. The peripheral web should be at least a few millimeters wide, but can also extend to the periphery of the top side or underside to which it is intended to be adhesively bonded. The lower part of this packaging with the recess shaped in a complementary manner to the protrusion 203 is not illustrated.

Figure 13:
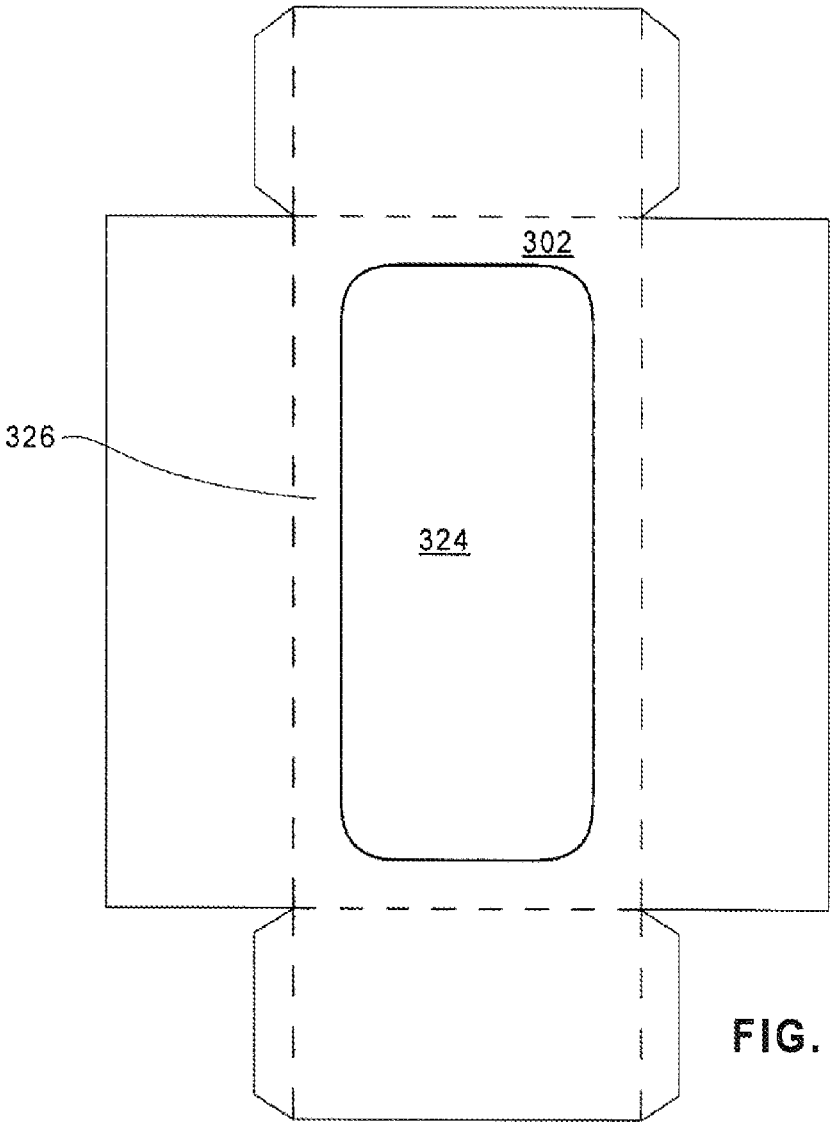
FIG. 13 shows a plan view of a cardboard blank for an upper part of another embodiment of the packaging container, according to embodiments of the system described herein.
Figure 14:
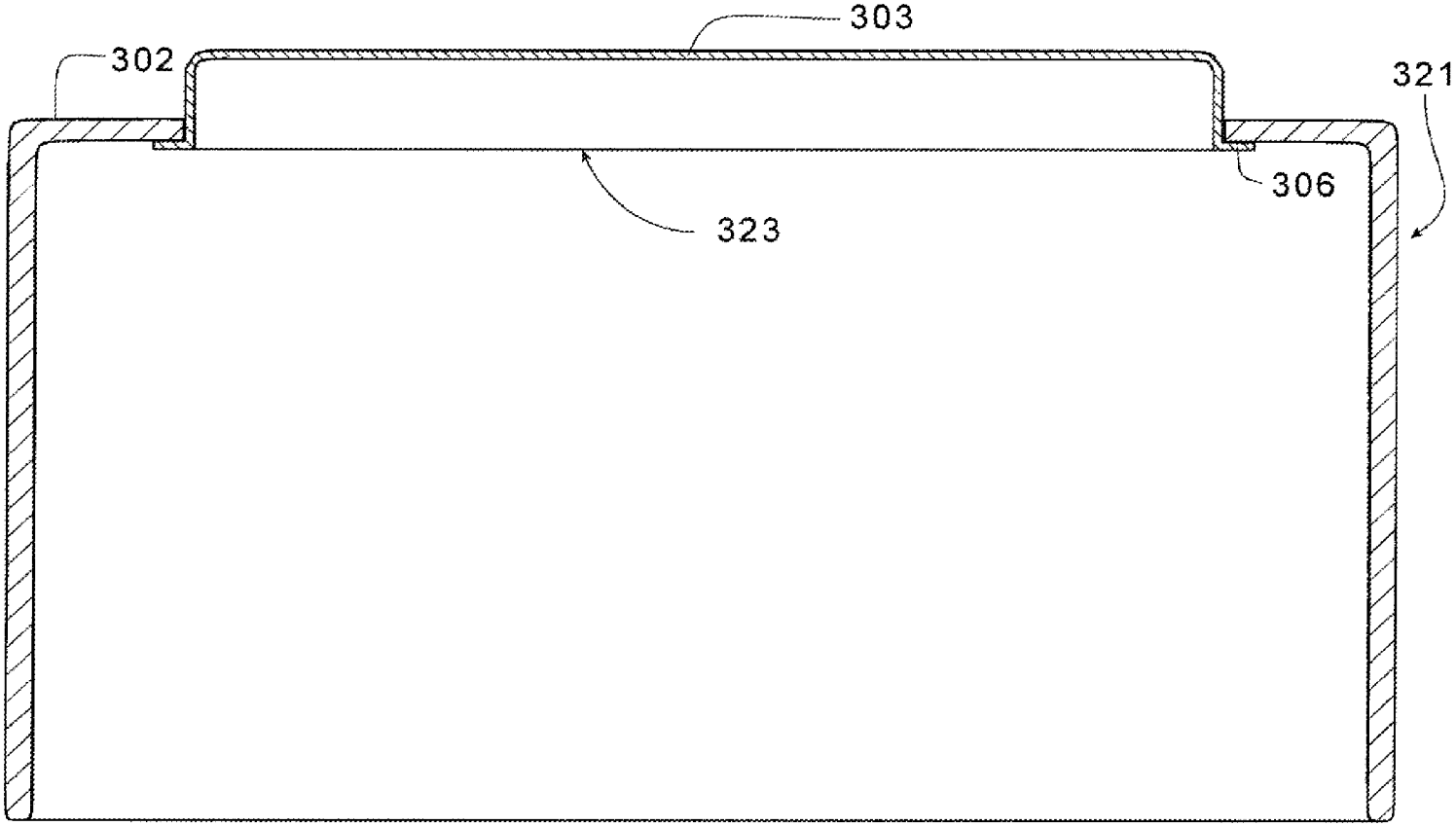
FIG. 14 shows a sectional side view of the upper part, assembled from the cardboard blank from FIG. 13, with an insert, according to embodiments of the system described herein.

FIGS. 13 and 14 show a cardboard blank 326 for a further top part 321 of a packaging carton described herein. FIG. 13 shows the plan view of the cardboard blank 326 from which the top part 321 is conventionally produced by folding and adhesive bonding, said top part 321 being shown in a sectional illustration in FIG. 14. In that portion of the cardboard blank 326 which forms the top side 302 of the container, a hole 324 has again been punched. The hole 324 substantially has a contour which corresponds to the contour of a smartphone. The protrusion 303 of the insert 323 substantially has the shape of a smartphone. In this case, contour lines can have been molded as screen boundaries and operating switches on the top side of the protrusion 303. The shape of the protrusion 303 can be as desired, depending on the choice of the product to be packaged. The shape can correspond to the shape of the packaged product or have some other product reference, a reference to the producer or to the brand or a logo of the producer. Any desired other shapes are selectable.

Here again, the lower part of the container with a recess formed in a complementary manner to the protrusion 303 has not been illustrated. However, it is clearly apparent that when the containers are placed one another, wherein the recess in the underside surrounds the protrusion 303 with little play, lateral slipping of the identically shaped containers stacked one on the other is prevented.

The inserts 223, 323 can have a further technical function. On the side remote from the top side and underside, respectively, of the packaging container, the inserts can have receptacles for the products to be received in the container. The receptacles can be formed by simple webs that project out of the inserts. The receptacles can also be formed in a more complex manner, however, and have a surface complementary to the surface of the received product when the inserts are made into any desired shapes for example using molded-pulp methods.

Figure 15:
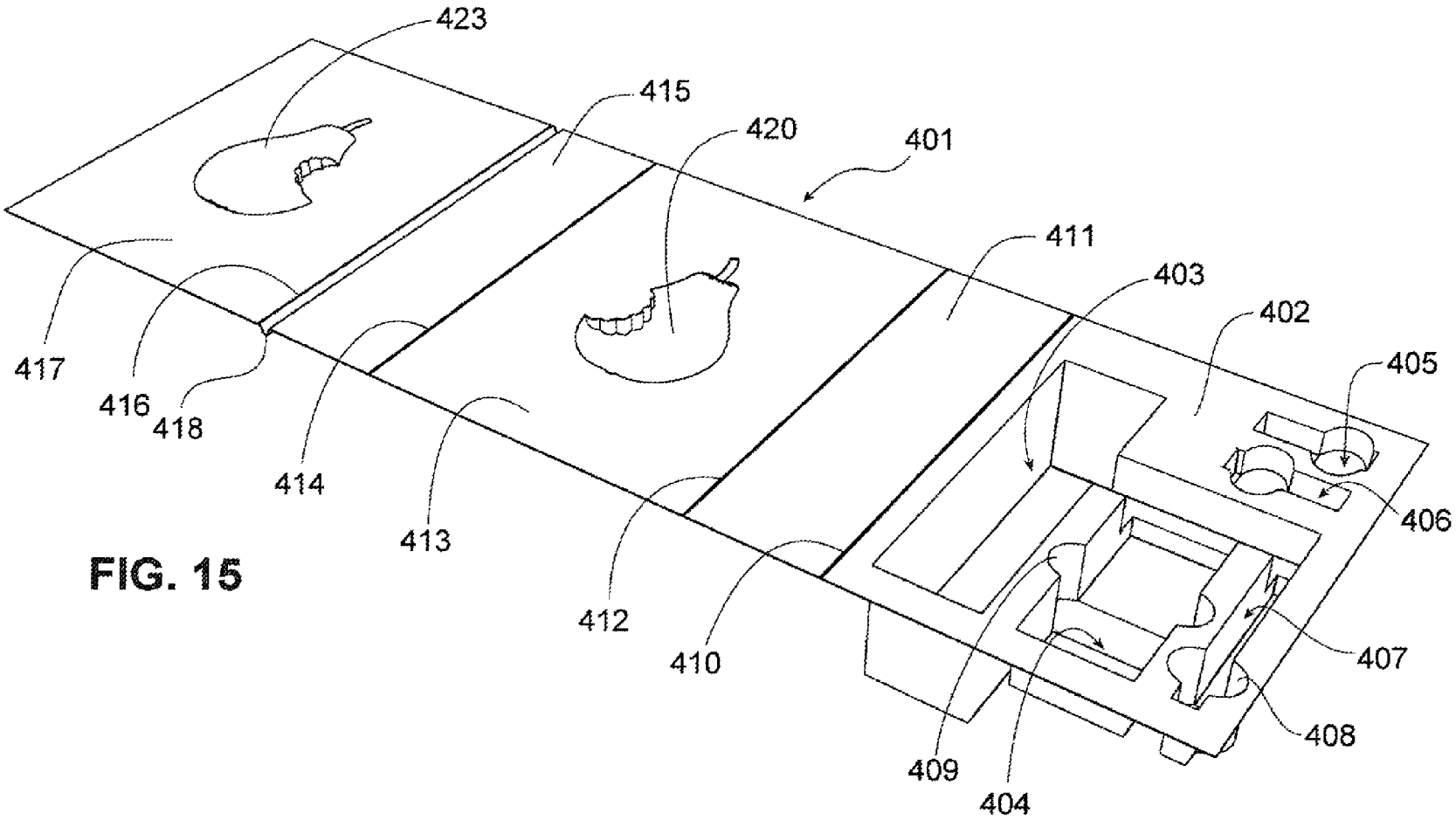
FIG. 15 shows a three-dimensional plan view of a cardboard blank which can be bent to form a packaging element which forms the inserts, according to embodiments of the system described herein.

FIG. 15 shows a cardboard blank 401 which forms the two inserts, and the receptacles for products to be introduced into the container. The cardboard blank 401 consists of a receiving portion 402. The receiving portion 402 has a plurality of receptacles 403-407 which can each receive a product to be introduced into the packaging. Each of the receptacles 403-407 is configured as a tray-like depression into which the products can be inserted. The receptacles 403-407 merge partially into one another. What is important is that the walls of the receptacles 403-407 fix the product to be inserted into them at least in a punctiform manner. The receptacle 403 is intended for example for a mobile telephone. The receptacle 404 can be intended for the power supply unit of the mobile telephone. The receptacle 405 can be intended for headphones or a power plug. The same goes for the receptacle 406. The receptacle 407 can be intended for a power supply cable. The shape and arrangement of the receptacles 403-407 can be matched as desired to the purpose of the respective packaging. It should be noted that the contours of the receptacles 403-407 do not have to correspond exactly to the contours of the products to be received. In FIG. 15, widened regions 408, 409 are provided which make it easier to grasp and remove the received products.

Such inserts made of different materials, in particular including cardboard or fiber material, are known from the prior art. In the context of the packaging described herein, the receiving portion is connected, as a constituent part of a cardboard blank, to the inserts. For this purpose, the receiving portion 402 is connected to a first side-wall portion 411 via a first bending line 410. Via a second bending line 412, the first side-wall portion is adjoined by a first cover-wall portion 413, in the middle of which a recess 420 in the form of a pear which has been bitten into is formed. The first cover-wall portion 413 merges via a third bending line 414 into the second side-wall portion 415. The second side-wall portion 415 is adjoined by a fourth bending line 416 and a second cover-wall portion 417. The second cover-wall portion 417 has the protrusion 423, which has a shape complementary to the recess 420.

Figure 17:
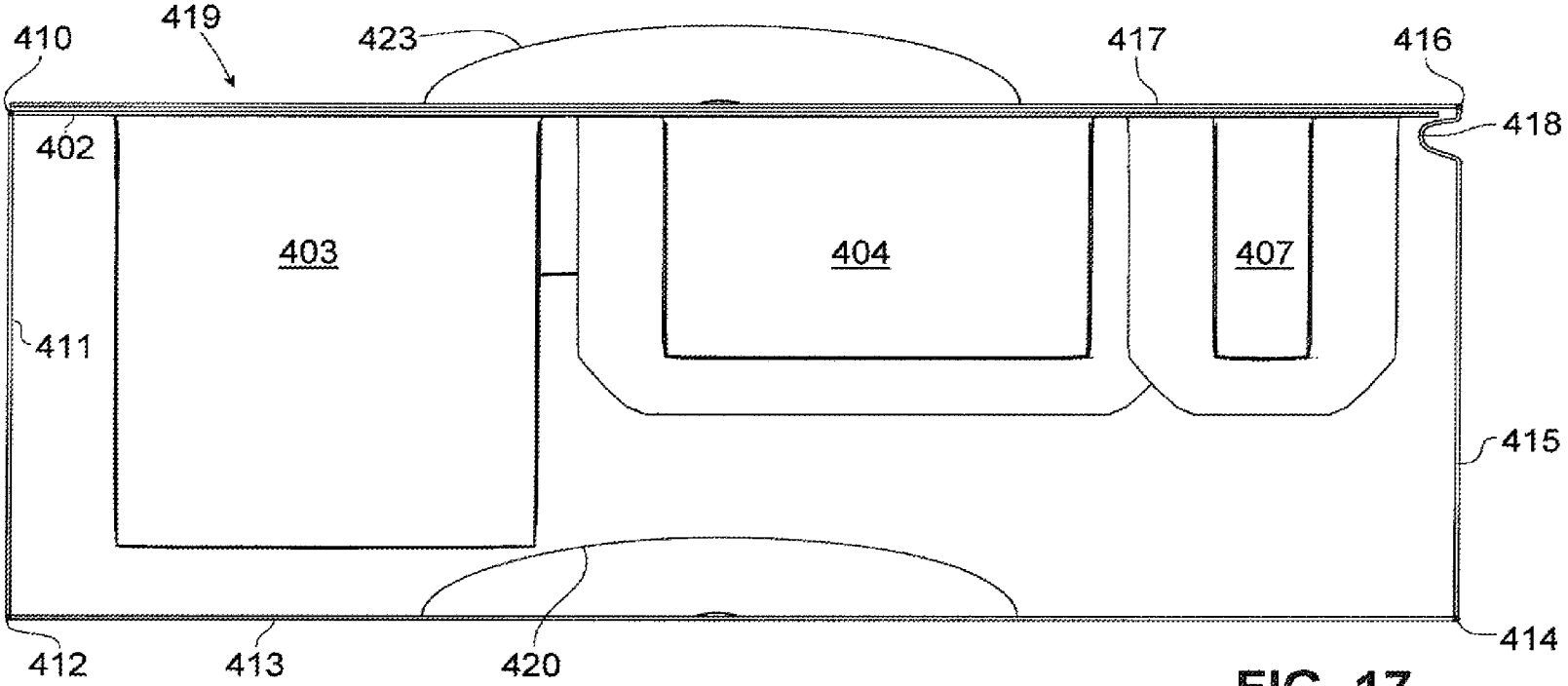
FIG. 17 shows a side view of the cardboard blank bent to form a packaging element, according to embodiments of the system described herein.

In some embodiments, all of the bending lines extend parallel to one another, and, at all of the bending lines, the mutually adjoining wall portions are bent through 90 degrees with respect to one another, such that bending along all of the bending lines produces the cuboidal packaging element 419 that can be seen in FIG. 17.

The packaging element 419 is cuboidal and can consequently be inserted into a box-like receiving carton 422, the lower wall of which has a hole 421 that matches the recess 420, the contour of said hole 421 corresponding to the contour of the recess 420 and said hole 421 having the same position as the recess 420 in bottom view. The packaging element 417 inserted into the receiving carton 422 can be seen in FIG. 18. In this case, both the receiving carton 422 and the lid 425 have been cut in the middle, such that the packaging element 419 is visible. The lid 425 has been placed on from above, a hole 424, the contour of which corresponds substantially to the contour of the protrusion 423, being formed in the top side 427 of said lid 425. The receiving carton 422 also has on its underside 428 a hole 426, which corresponds in contour and position to the contour and position of the recess 420. The lid 425 and the receiving carton 422 form, apart from in the region of the protrusion 423 and of the recess 420, the outer side of the packaging container 400 from FIG. 18.

Figure 16:
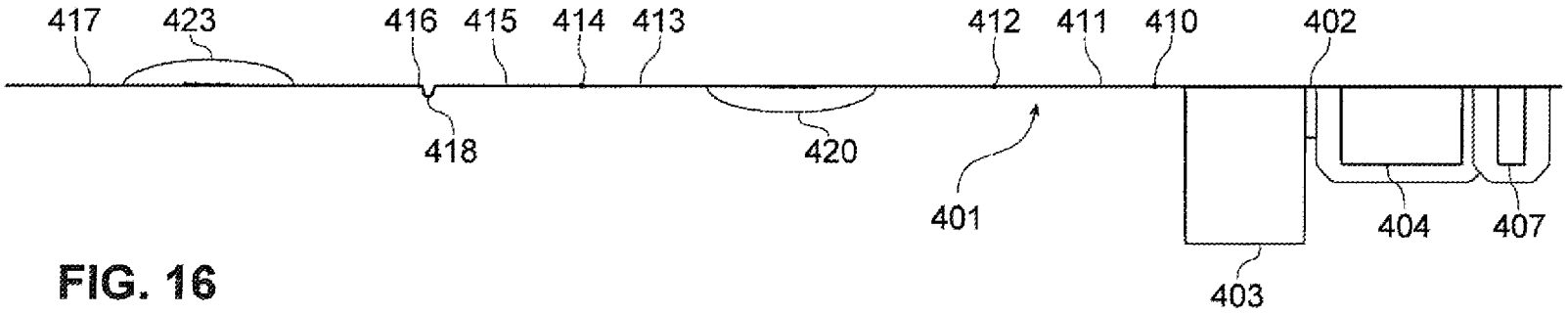
FIG. 16 shows a side view of the cardboard blank from FIG. 15, according to embodiments of the system described herein.
Figure 18:
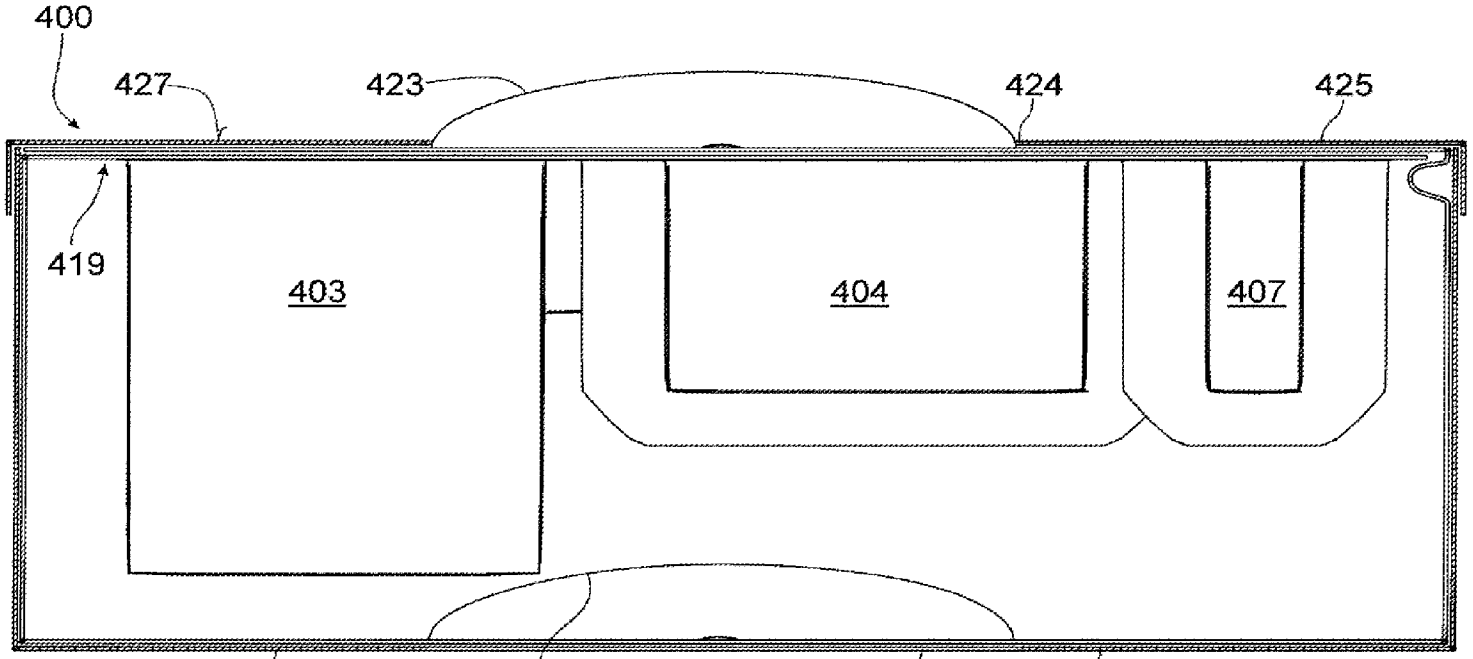
FIG. 18 shows the packaging element from FIG. 17 when it has been inserted into the box-like receiving carton with a lid, wherein the receiving carton and lid have been cut in the middle; according to embodiments of the system described herein.

FIGS. 16, 17 and 18 reveal that, in the vicinity of the fourth bending line 416, a curved relief portion 418 is arranged, with which dimensional inaccuracies of the cardboard blank 401 can be compensated.

In practice, the cardboard blank can be formed from molded pulp. Molded pulp is an environmentally friendly material made of pulp fibers which can be obtained from renewable and biodegradable raw materials and also from waste paper. Usually, packaging inserts, but also beer mats and egg boxes, are manufactured from molded pulp. Molded pulp is particularly suitable for manufacturing complex shapes from pulp fibers in a cost-effective manner.

The features of the system described herein which are disclosed in the present description, in the drawings and in the claims can be essential both individually and in any desired combinations for the realization of the system described herein in its various embodiments. The invention is not limited to the described embodiments. It can be varied within the scope of the claims and taking the knowledge of a competent person skilled in the art into account.

The invention claimed is:

1. A packaging container, comprising:

a top side having a plurality of protrusions extending therefrom;

an underside extending parallel to the top side and having a plurality of recesses therein that correspond to the plurality of protrusions;

a first side wall extending from the top side to the underside, the first side wall being foldable along a weakening line in a vicinity of, and parallel to, a lower horizontal edge of the first side wall to provide an opening in the packaging container; and a drawer arranged above the plurality of recesses of the underside, the drawer being slidable from the packaging container with the first side wall open, wherein the top side includes at least one first hole and the underside includes at least one second hole, and wherein the plurality of protrusions and the plurality of recesses have been applied to inserts which have been inserted into the packaging container.

2. The packaging container of claim 1, wherein the inserts include a biodegradable fiber material.

3. The packaging container of claim 1, wherein the plurality of protrusions defines a three-dimensional surface region bulging out of the packaging container, and wherein the plurality of recesses defines a three-dimensional surface region extending into the packaging container.

4. The packaging container of claim 1, wherein a primary surface of the drawer is parallel to the underside.

5. The packaging container of claim 1, further comprising:

a second side wall extending from the top side to the underside;

a third side wall, parallel to the second side wall and extending from the top side to the underside, wherein the second side wall and the third side wall are perpendicular to the first side wall and wherein the drawer extends from the second side wall to the third side wall.

6. The packaging container of claim 1, wherein the drawer rests on top of portions of the plurality of recesses that extend in to the packaging container.

7. The packaging container as claimed in claim 1, wherein a part of the first side wall is able to be folded open and is connected to a remaining part of the first side wall via a perforation extending in a vicinity of and parallel to an upper horizontal edge of the first side wall and in the vicinity of and parallel to two vertical edges of the first side wall.

8. The packaging container as claimed in claim 7, wherein a tear-off perforation strip is formed by two parallel perforation lines.

9. The packaging container as claimed in claim 1, wherein the plurality of protrusions includes four, six or eight conical protrusions and the plurality of recesses includes a same number of receiving recesses as a number of the conical protrusions.

10. The packaging container as claimed in claim 1, wherein the top side, the underside and the first side wall of the packaging container are formed from at least one paperboard blank.

11. The packaging container as claimed in claim 1, wherein the packaging container includes a lower part and an upper part that engages around the lower part, and wherein a first insert of the inserts includes the plurality of recesses and has been inserted into the lower part and a second insert of the inserts includes the plurality of protrusions and has been inserted into the upper part.

12. The packaging container as claimed in claim 11, wherein the upper part includes the first side wall, a window has been punched out of a side wall of the lower part, the side wall of the lower part coming to rest against the a side wall of the upper part, the window corresponding, after the upper part has been put on, to a part of the side wall of the upper part that is able to be folded open.

13. The packaging container as claimed in claim 1, wherein the inserts have, on the side remote from the top side and underside, respectively, receptacles for products to be received in the container.

14. The packaging container as claimed in claim 1, wherein the inserts are constituent parts of a cardboard blank which has the following portions that are connected together via bending lines:

a receiving portion with at least one receptacle, the shape of which matches the shape of a product to be received in the container;

a first side-wall portion;

a first cover-wall portion, which has at least one recess;

a second side-wall portion; and a second cover-wall portion, which has at least one protrusion with a shape and position complementary to the recess.

15. The packaging container as claimed in claim 1, wherein the plurality of protrusions and the plurality of recesses have complementary shapes and are applied at mutually corresponding positions, such that an underside of a second packaging container shaped identically to the packaging container is able to be placed in a flush manner on the top side of the packaging container, and wherein the plurality of protrusions arranged on the top side project into the plurality of recesses having a complementary shape on the underside of the second packaging container.

16. The packaging container as claimed in claim 1, wherein the packaging container has at least one of the following features:

the at least one protrusion on the top side has the shape of a symbol, in particular a number or a letter; and the at least one protrusion has the shape of a product received in the container.

17. The packaging container of claim 1, wherein each of the inserts has a generally planar shape extending in parallel to the top side and the underside.

18. The packaging container of claim 17, wherein each of the at least one recess defines a three-dimensional region extending from a generally planar surface of the insert.

19. The packaging container of claim 1, wherein each of the inserts has a generally planar shape, and each of the at least one recess defines a three-dimensional region extending from a generally planar surface of the insert.

20. The packaging container of claim 1, wherein the plurality of recesses maintain a closed surface.

* * * * *